United States Patent [19]

Frick, Jr. et al.

[11] Patent Number: 4,619,668

[45] Date of Patent: Oct. 28, 1986

[54] DYED WRINKLE-RESISTANT AND DURABLE-PRESS COTTON FABRICS

[75] Inventors: John G. Frick, Jr., New Orleans, La.; Brian W. Jones, Raleigh, N.C.; Robbie L. Stone, Cary, N.C.; Michael D. Watson, Raleigh, N.C.

[73] Assignee: The United States of America as represented by the Secretary of Agriculture, Washington, D.C.

[21] Appl. No.: 774,698

[22] Filed: Sep. 11, 1985

[51] Int. Cl.[4] ..... D06P 5/00

[52] U.S. Cl. ..... 8/496; 8/585; 8/116.4

[58] Field of Search ..... 8/116.4, 181, 184, 194, 8/496, 585

[56] References Cited

U.S. PATENT DOCUMENTS

| | | | |
|---|---|---|---|
| 2,785,948 | 3/1957 | Abrams | 8/116 |
| 4,076,870 | 2/1978 | Yamamoto | 427/390 |
| 4,332,586 | 6/1982 | North | 8/186 |

OTHER PUBLICATIONS

Heap, S. Allan, "A Consideration of the Critical Add On and the Uniformity of Crosslinking", Textile Research Journal, Mar. 1979, pp. 150–155.

Boer, J. J., "The Determination of the Degree of Migration of Easy Care Chemicals in Cotton Fabrics", Textile Research Journal, Nov. 1980, pp. 648–653.

Reeves, Wilson, A.; Rita M. Perkins, Leon H. Chance, "Cotton Cross-Linked at Various Degrees of Fiber Swelling", *Textile Research Journal*, vol. 30, pp. 179–192 (1960).

Pierce, A. G., J. G. Frick, Jr., J. David Reid, "Retention of Swelling Ability in Cotton Cross-Linked with High-Temperature Curing", *Textile Research Journal*, vol. 34, pp. 552–558 (1964).

Frick J. G., Jr.; Robert J. Harper, "Adducts of Glyoxal and Amides as Finishing Agents for Cotton", *Textile Research Journal*, vol. 51, pp. 601–606 (1981).

*Primary Examiner*—Paul Lieberman
*Assistant Examiner*—Brooks Alan Truskett
*Attorney, Agent, or Firm*—M. Howard Silverstein; David G. McConnell; Raymond C. Von Bodungen

[57] ABSTRACT

A cellulosic fabric is treated with a crosslinking agent selected from the group consisting of: an adduct from an amide and glyoxal, an acetal derived from a dialdehyde and an aldehyde other than formaldehyde and an acidic catalyst. The catalyst and crosslinking agent is of sufficient amount and concentration to impregnate the fabric and produce wrinkle-resistance and smooth-drying finishes when dried from about 3–10 minutes at from about 60°–100° C. and then cured from about 1–5 minutes at from about 120°–180° C. The resultant fabric is then dyed.

9 Claims, No Drawings

DYED WRINKLE-RESISTANT AND DURABLE-PRESS COTTON FABRICS

BACKGROUND OF THE INVENTION (1) Field of the Invention

This invention relates to dyeing finished textiles containing cellulose.

(2) Description of the Prior Art

Treatments for fabrics composed of cellulose and mixtures of cellulose with other polymers to render them wrinkle-resistant and durable-press, or self-smoothing on laundering, consist of applying and reacting a finishing agent on cellulose. These treatments form crosslinks or bonds between the linear cellulose molecules of which the fiber is composed. These finishing agents, or crosslinking agents, are typically made from the reaction of formaldehyde with polyamide to make a polyfunctional methylolamide or hydroxymethylamide. These methylolamides are applied from water and, after drying, react readily with cellulose under the influence of mild catalysts. Because they have more than one reactive methylolamide group, they form bridges, or crosslinks, between the linear cellulose molecules.

These crosslinking treatments do increase the wrinkle resistance and durable-press properties of the cellulosic fabric but also decrease the ability of the fiber to absorb moisture. This is shown by a lower moisture content of fabric when exposed to atmospheric moisture. The decreased absorptivity is also manifested in a decreased ability to absorb and retain dyes. The dyeability of the fabric is reduced to such an extent that, when a colored fabric is desired, the fabric must be dyed before the crosslinking treatment and therefore, before the manufacture of a garment or other textile article from the fabric. The choice of color in the textile then is restricted to those colors selected before the fabric is treated.

It has been possible to crosslink cellulosic fibers for wrinkle-resistance and durable-press with less restriction of absorptivity and dyeability, but the methods used are impractical for manufacturing commercial textiles. An example of such a method is described by Reeves, Perkins and Chance, Textile Research Journal vol. 30, pp. 179–192 (1960), which employs crosslinking while the fabric remains wet with the solution of crosslinking agent. This process is impractical because it requires a long reaction time in the presence of a strongly acidic catalyst. Another method described by Pierce, Frick and Reid, Textile Research Journal vol. 34, pp. 552–558 (1964), employs a standard process with inert components to inhibit deswelling on drying. This method is also impractical because large amounts of expensive materials are needed for the inert component.

Frick and Harper, Textile Research Journal vol. 51, pp. 601–606 (1981) disclose adducts of glyoxal and amides which are used as finishing agents for cotton solely as a means of eliminating formaldehyde fumes from the agent.

SUMMARY OF THE INVENTION

Previously known treatments for imparting wrinkle-resistance and durable-press properties to cellulosic fabric rendered the fabric resistant to dyeing. The decrease in dyeability occurs with the existing treatments because they restrict the absorptivity of the cellulosic fiber. Consequently, those skilled in the art of making such fabrics considered them as difficult or impossible to dye after processing. Therefore, when color was desired, the fabric needed to be dyed before treatment and before a textile article was made from the fabric. With this discovery, cellulosic fabric is treated for wrinkle-resistance and durable-press using finishing agents not made from formaldehyde, and the treated fabric retains a greater absorptivity and affinity for dyes. It can, therefore, be dyed after treatment and after a garment or other textile article is made from the fabric. These agents may be from more than one chemical class and include some alpha-hydroxyamides similar to the reaction products from formaldehyde and amides.

A fabric either entirely or in part of cellulose is treated with a formaldehyde-free crosslinking agent selected from the group consisting of: an adduct from an amide and glyoxal, an acetal derived from a dialdehyde, and an aldehyde other than formaldehyde with a mildly acidic catalyst. The crosslinking agent and catalyst are of sufficient amounts and concentrations to impregnate and render the cellulosic fabric wrinkle-resistant and self-smoothing after the fabric is dried and cured for sufficient time at sufficient temperatures. The resultant fabric is then dyed.

DESCRIPTION OF THE PREFERRED EMBODIMENTS

A finishing agent for use in this invention is selected from compounds that contain two or more groups reactive to hydroxy compounds such as cellulose and that are not made from formaldehyde. For ease of application the selected compound is preferably soluble in water. An example of such an agent is 4,5-dihydroxy-1,3-dimethyl-2-imidazolidinone, a compound made from the reactionof 1,3-dimethylurea and glyoxal. Another example of a suitable agent is the acetal, 1,1,4,4-tetramethoxybutane.

The selected agent is applied to fabric from a solution preferably in water or a solvent composed predominantly of water. The solution will also contain a mildly acidic substance to catalyze the reaction of the agent with the cellulose. Particularly suitable as catalysts are metal salts such as magnesium chloride, zinc nitrate, and zinc fluoroborate. Concentrations in the solution will be adjusted to deposit an amount of agent equal to 5–20% of fabric weight and an amount of catalyst equal to 0.5–3.0% of fabric weight depending on the reactivity of the compounds selected. The solution is applied by any convenient means. One suitable method is by passing the fabric into the solution and then through squeeze rolls to leave a 60–100% weight gain on the fabric. The wet fabric is dried from about 3–10 min at 60°–100° C. and then heated or cured, at 120°–180° C. for 1–5 min to promote reaction of the agent with cellulose such as in cotton fabric. Preferably the fabric is then washed to remove any unreacted materials and products of side reactions.

Cellulosic fabric so treated is more absorbent than fabric treated to the same level of wrinkle resistance and durable-press with conventional agents made from formaldehyde. The greater absorbency appears not only in higher dye receptivity but in the higher moisture content of fabric exposed to air. The greater dye receptivity of fabric treated by the process of this invention can be noted with all dye classes usually applied to cellulosic fibers. However, the effect is greatest with direct dyes where the dye receptivity approaches that of untreated fabric.

The following examples are offered to illustrate the process of the present invention. All percentages in the examples are by weight. Testing of treated fabric was by methods described in the Technical Manual of the American Association of Textile Chemists and Colorists.

EXAMPLE 1

Cotton printcloth was impregnated by padding with an aqueous solution containing 6% 4,5-dihydroxy-1,3-dimethyl-2-imidazolidinone (concentrations in the range of 5–12% can be used), a compound prepared from 1,3-dimethylurea and glyoxal, and 1.2% magesium chloride (concentrations in the range of 0.5–2% can be used) hexahydrate to give about 90% weight gain. The fabric was dried 7 min to 70° C., cured 3 min at 160° C., and then washed. For comparison, the same fabric was treated with a 2% solution of the conventional finishing agent dimethyloldihydroxyethyleneurea, a compound prepared from urea, glyoxal and formaldehyde. Both treated fabrics have a wrinkle-recovery angle of 240°–245°, sum of results from testing in the warp and filling directions, and a durable-press rating of 3.0–3.3 in tests for wrinkle-resistance and appearance after laundering. Portions of both treated fabrics and of untreated fabric were dyed by standard procedures with a direct dye (Direct Red 81), a vat dye (Vat Brown 3), and a reactive dye (Reactive Blue 109). The depth of color was rated on an arbitrary scale of 1 to 5 with the darkest color from each dyeing rate as 5. Results following in Table 1 show the greater dyeability that resulted from the use of the formaldehyde-free agent dihydroxydimethylimidazolidinone in place of the conventional finishing agent.

TABLE 1

| Agent Applied | Depth of Color Direct Dyeing | Vat Dyeing | Reactive Dyeing |
|---|---|---|---|
| None | 5 | 5 | 5 |
| Dihydroxydimethyl-imidazolidinone | 5 | 3 | 3 |
| Conventional Agent | 3 | 1 | 2 |

EXAMPLE 2

Cotton printcloth was treated with the formaldehyde-free finishing agent 1,1,4,4-tetramethoxybutane. This agent is an acetal that can be prepared from 2,5-dimethoxytetrahydrofuran and methanol. The fabric is impregnated by padding with a solution containing 10% 1,1,4,4,-tetramethoxybutane (concentrations in the range of 10–20% by weight can be used) and 1.6% magnesium chloride hexahydrate (concentrations in the range of 1.6–2.8% by weight can be used), dried 7 min at 70° C., cured 3 min at 160° C., then washed. For comparison, the same fabric was treated with a 2% solution of the conventional finishing agent dimethylolethyleneurea, a compound prepared from 2-imidazolidinone and formaldehyde. Both fabrics had a durable-press rating of 3.3–3.4 and a wrinkle recovery angle of 237°–242°, sum of values testing in the warp and filling directions. Portions of both fabrics and an untreated fabric were dyed with a reactive dye (Reactive Blue 109) using pad-bake procedure and an exhaust procedure. Depth of color after dyeing was rated on a scale of 1 to 5 with a rating of 5 given to the darkest color from each dyeing. Results in Table 2 show the retention of dyeability is greater in the wrinkle-resistant fabric from treatment with tetramethoxybutane than in the wrinkle-resistant fabric from treatment with the conventional agent.

TABLE 2

| Agent Applied | Depth of Color Pad Bake Dyeing | Exhaust Dyeing |
|---|---|---|
| None | 5 | 5 |
| Tetramethoxybutane | 3 | 2 |
| Conventional Agent | 2 | 1 |

EXAMPLE 3

Cotton printcloth was treated with the formaldehyde-free agent 2,5-dimethoxytetrahydrofuran by the following procedure. Fabric is impregnated by padding wth an aqueous solution containing 10% 2,5-dimethoxytetrahydrofuran (concentrations in the range of 10–20% can be used) 0.5% magnesium chloride hexahydrate (concentrations in the range of 0.2–0.8% can be used), and 0.5% citric acid (concentrations in the range of 0.2–0.8% can be used), and was then dried 7 min at 70° C., heated 3 min at 120° C., and washed. The treated fabric had a wrinkle recovery angle of 265°, sum of warp and fill values, and a durable press rating of 3.6. For comparison, another portion of the same fabric was treated with 6.0% solution of the conventional finishing agent dimethyloldihydroxyethyleneurea; this fabric had a wrinkle recovery angle of 267° and a durable-press rating of 4.0. Samples of both treated fabrics and an untreated fabric were dyed with Direct Red 81 and with Reactive Blue 109. The following results in Table 3 show that the fabric treated with the formaldehyde-free agent dyed to a darker color than the fabric treated with the conventional agent.

TABLE 3

| Agent Applied | Depth of Color Direct Red 81 | Reactive Blue 109 |
|---|---|---|
| None | 5 | 5 |
| Dimethoxytetrahydrofuran | 4 | 3 |
| Dimethyloldihydroxyethyleneurea | 2 | 2 |

EXAMPLE 4

Cotton printcloth was treated with glutaraldehyde as a formaldehyde-free finishing agent. The fabric was impregnated by padding with a solution containing 7.6% glutaraldehyde (concentrations in the range of 6–20% by weight can be used) and 2.0% magnesium chloride hexahydrate (concentrations in the range of 2.0–3.0% by weight can be used), dried 7 min at 70° C., cured 3 min at 160° C., and washed. The same fabric was treated with an 8.0% solution of the conventional finishing agent dimethyloldihydroxyethyleneurea. Both treated fabrics have a durable-press rating of 3.3–3.5 and a wrinkle recovery angle of 269–270° C., sum of warp and fill values. Portions of both treated fabrics and an untreated fabric were dyed with Direct Red 81 and Reactive Blue 109. Depth of color on the dyed fabrics is rated on a scale of 1 to 5 with the results following in Table 4 showing the greater receptivity to the dyes of fabrics treated with the formaldehyde-free agents.

TABLE 4

| Agent Applied | Depth of Color | |
|---|---|---|
| | Direct Red 81 | Reactive Blue 109 |
| None | 5 | 5 |
| Glutaraldehyde | 4 | 3 |
| Dimethyloldihydroxyethyleneurea | 2 | 2 |

We claim

1. A process for producing a dyed fabric composed entirely or in part of cellulose that has been rendered wrinkle-resistant and selfsmoothing comprising:

(a) treating a cellulosic fabric with a crosslinking agent selected from the group consisting of: an adduct from an amide and glyoxal, an acetal derived from a dialdehyde, and an aldehyde other than formaldehyde, and an acidic catalyst, said crosslinking agent and acid catalyst being of sufficient amounts and concentrations to impregnate and render said cellulosic fabric wrinkle-resistant and self-smoothing;

(b) and then drying and curing said fabric for sufficient time at sufficient temperatures to render said cellulosic fabric wrinkle-resistant and self-smoothing;

(c) subsequently dyeing the cured fabric.

2. The process of claim 1 including an additional step of washing the fabric after curing.

3. The process of claim 2 wherein the cellulosic fabric is cotton.

4. The process of claim 3 wherein the fabric is dried for about 3 to 10 minutes at from about 60° to 100° C. and cured for about 1 to 5 minutes at from about 120° to 180° C.

5. The process of claim 4 wherein the crosslinking agent is from about 5–12% 4,5-dihydroxy-1,3-dimethyl-2-imidazolidinone and the catalyst is from about 0.5–2.0% magnesium chloride.

6. The process of claim 4 wherein the crosslinking agent is from about 10–20% 1,1,4,4-tetramethoxybutane and the catalyst is from about 1.6–2.8% magnesium chloride.

7. The process of claim 4 wherein the crosslinking agent is from about 6–20% glutaraldehyde and the catalyst is from about 2.0–3.0% magnesium chloride.

8. The process of claim 4 wherein the crosslinking agent is from about 10–20% 2,5-dimethoxytetrahydrofuran and the catalyst is from about 0.2–0.8% magnesium chloride hexahydrate and from about 0.2–0.8% citric acid.

9. The process of claim 4 wherein the acid catalyst is a metal salt selected from the group consisting of: magnesium chloride, zinc nitrate, and zinc floroborate.

* * * * *